US007090462B2

(12) United States Patent
Martin et al.

(10) Patent No.: US 7,090,462 B2
(45) Date of Patent: Aug. 15, 2006

(54) COMPRESSOR BLEED AIR MANIFOLD FOR BLADE CLEARANCE CONTROL

(75) Inventors: Nicholas Francis Martin, Simpsonville, SC (US); Gregory Allan Crum, Mauldin, SC (US); Martel Alexander McCallum, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 156 days.

(21) Appl. No.: 10/920,166

(22) Filed: Aug. 18, 2004

(65) Prior Publication Data

US 2006/0039782 A1 Feb. 23, 2006

(51) Int. Cl.
*F01D 25/14* (2006.01)

(52) U.S. Cl. ..... 415/144; 415/214.1

(58) Field of Classification Search ..... 415/144, 415/214.1

See application file for complete search history.

(56) References Cited

U.S. PATENT DOCUMENTS 2,971,334 A * 2/1961 Carlson ..... 60/791
6,109,868 A * 8/2000 Bulman et al. ..... 415/144
6,325,595 B1 * 12/2001 Breeze-Stringfellow et al. ..... 415/144

* cited by examiner

*Primary Examiner*—Ninh H. Nguyen
(74) *Attorney, Agent, or Firm*—Nixon & Vanderhye P.C.

(57) ABSTRACT

A compressor bleed air manifold includes annular outer flanges on opposite sides of the generally annular manifold plenum. The outer and inner flange geometries may be circumferentially tailored to produce optimal case stiffness and thermal response for blade-to-case clearances. The inner flanges are secured to one another by an inner bolt circle radially adjacent the flow path thereby improving the case stiffness, out of roundness and eliminating unsupported sections of the flowpath along an outer diameter thereof. The flanges of the outer bolt circle seal the plenum. The compressor bleed air manifold and the compressor casing load path are thereby isolated from one another.

20 Claims, 2 Drawing Sheets

COMPRESSOR BLEED AIR MANIFOLD FOR BLADE CLEARANCE CONTROL

BACKGROUND OF THE INVENTION

The present invention relates to a compressor bleed manifold having enhanced blade clearance control and particularly relates to a compressor bleed manifold mechanically isolated from the compressor casing load path.

The outer diameter compressor clearance is typically defined as the rotating blade to compressor casing inner wall radial distance. Generally, reducing the compressor clearance is desirable for improved performance. Current turbine single shell casing design requires the single shell to carry both the engine loads as well as to maintain a round, tight clearanced flow path. The problem of maintaining a tightly clearanced flow path is compounded by the typical compressor bleed air manifold which disrupts the smooth load path through the compressor casing, creates unsupported casing wall portions which lead to deflections radially inwardly or outwardly of the flow path, increases the flow path to bolted flange distance, limits extraction pipe locations and resultant loads onto the casing, and creates thermal response mismatches between the rotor and casing.

Compressor bleed manifolds conventionally include axially opposed cylindrical manifold sections having vertical flanges bolted to one another securing the axially opposite respective casing and manifold sections to one another. This vertical bolt circle lies a substantial distance radially outwardly from the flow path. The annular plenum of the manifold lies between the bolt circle through the vertical flanges and a continuous annular compressor bleed air slot opening radially between the flow path and the plenum. The wall portions defining the slot are typically unsupported and there is no continuous hoop load path through the casing portions adjacent the slot. Because the bolt circle is radially outwardly of the flow path, the stiffness and gravitational sag of the casing present problems with clearance control. Accordingly, there is a need for optimized clearance control at a compressor bleed air manifold.

BRIEF DESCRIPTION OF THE INVENTION

In accordance with a preferred aspect of the present invention, a compressor bleed air manifold is mechanically isolated from the engine casing load path, enabling optimal casing stiffness and thermal response requirements while also eliminating the unsupported wall portions defining the continuous bleed air slot in prior compressors. Additionally, the isolation affords increased flexibility for extraction air pipe routing and isolates extraction pipe loads from the casing structure. To accomplish the foregoing, the bleed manifold is provided with radially outer and inner bolt circles defining the radial location of a shaped, generally annular, manifold plenum between the bolt circles. The inner bolt circle lies close to the flow path, enabling flow path sealing and roundness control. The outer bolt circle maintains the manifold plenum seal. The manifold is thus isolated from the load carrying compressor casing. This enables a variance of the outer bolt circle radial extent (height) and manifold cross section as a function of circumferential position further enabling a tailoring of the case stiffness and thermal response to best minimize case out-of-roundness inherent in a horizontal split case configuration. In other aspects, axially projecting sectors on one or both of the axially opposite casing sections engage one another and receive the bolts forming the inner bolt circle. These sectors also define generally radially oriented flow slots for bleeding air into the plenum. These slots may be aerodynamically shaped to minimize losses.

In a preferred embodiment of the invention there is provided a compressor comprising: a cylindrical casing about an axis of the compressor including axially opposed casing sections; a manifold including axially opposed generally annular manifold sections radially outwardly of and integral with the respective casing sections and defining a manifold plenum in communication with a flow path through the compressor casing; each said manifold section including radially spaced inner and outer flanges on opposite radial sides of the plenum; and bolts through the inner and outer flanges, respectively, forming inner and outer bolt circles securing the axially opposed casing sections to one another and the axially opposed manifold sections to one another.

In a further embodiment of the invention there is provided a compressor comprising: a cylindrical casing about an axis of the compressor including axially opposed casing sections; a manifold including axially opposed generally annular manifold sections radially outwardly of and integral with the respective casing sections and defining a manifold plenum in communication with a flow path through the compressor casing; each said manifold section including radially spaced inner and outer flanges on opposite radial sides of the plenum; and bolts through the inner flanges defining an inner bolt circle for sealing about a compressor flow path through the casing sections and bolts through the outer flanges for sealing about the plenum, the inner and outer bolt circles securing the axially opposed casing sections to one another and the axially opposed manifold sections to one another.

In a still further embodiment of the invention there is provided a compressor comprising: a cylindrical casing about an axis of the compressor including axially opposed casing sections, each of the axially opposed casing sections includes a pair of generally semi-cylindrical casing members having circumferentially opposed axially extending flanges secured one to the other along an axially extending midline of the compressor; a manifold including axially opposed generally annular manifold sections radially outwardly of and integral with the respective casing sections and defining a manifold plenum in communication with a flow path through the compressor casing each of the axially opposed manifold sections includes a pair of generally semi-annular manifold members having circumferentially opposed flanges secured to one another along an axially extending midline of the compressor; each the manifold member including radially spaced, inner and outer vertical flanges on opposite radial sides of the plenum; bolts through the inner and outer vertical flanges, respectively, forming inner and outer bolt circles about the axis securing the axially opposed casing sections to one another and the axially opposed manifold sections to one another; and circumferentially spaced array of axially projecting sectors on one of the manifold sections in engagement with another of the manifold sections axially opposite the one manifold section and defining circumferentially spaced flow slots therebetween for bleeding compressor air from within the casing into the manifold plenum.

DETAILED DESCRIPTION OF THE INVENTION

Figure 1:
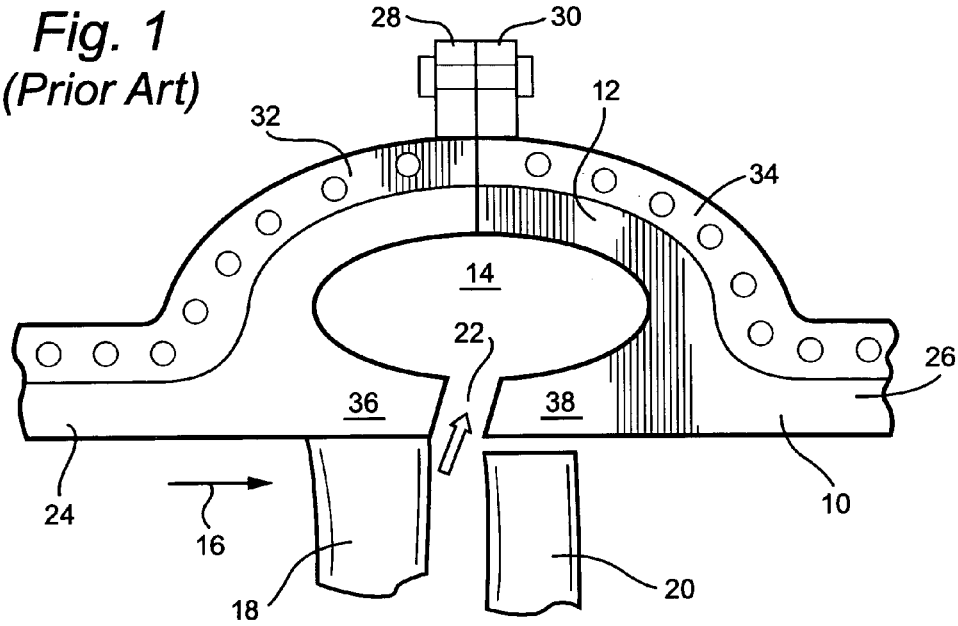
Fig. 1 (Prior Art)
FIG. 1 is a fragmentary plan view of a prior art compressor bleed air manifold and bolting arrangement along a horizontal midline of a compressor casing.

Referring now to the drawings, particularly to FIG. 1 there is illustrated a compressor casing 10 having a bleed air manifold 12 defining a plenum 14. The axial flow direction of the air flowing through the flow path of the compressor is indicated by the arrow 16. The flow path includes a plurality of stator vanes 18 and rotor blades 20, only one each being illustrated. It will be appreciated that the compressor comprises multiple stages each including a plurality of stator vanes and rotor blades. Downstream of an array of stator vanes 18 of a predetermined stage, there is provided a continuous annular slot 22 communicating bleed air from the flow path 16 into the plenum 14. Various extraction ports, now shown, communicate with the bleed air in the plenum 14 for distribution to areas of the turbine which require compressor bleed air.

As illustrated in FIG. 1, the prior art compressor casing 10 includes a pair of axially opposed compressor sections 24 and 26 joined one axially to the other by a vertical bolt circle extending through opposed flanges 28 and 30 of the casing sections 24 and 26. Additionally, each of the casing sections 24 and 26 is split along a horizontal midline to define semi-circular casing members joined along the horizontal midline by bolts passing through adjoining horizontal flanges 32 and 34. It will be appreciated from a review of FIG. 1 that the wall portions 36 and 38 adjacent bleed air slot 22 are unsupported and may deflect inwardly or outwardly. Also, the single bolt circle securing the casing sections 24 and 26 to one another is spaced radially outwardly of the plenum 14 which deleteriously affects the stiffness and sag of the compressor casing.

Figure 2:
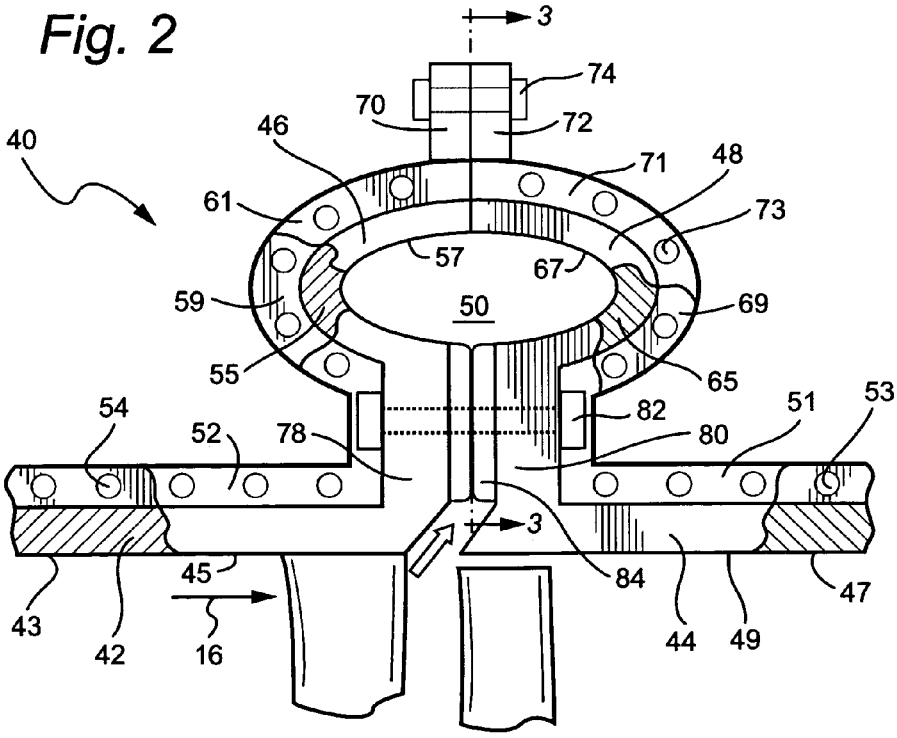
FIG. 2 is a similar view illustrating a compressor bleed air manifold in accordance with a preferred aspect of the present invention.

Referring now to FIG. 2, there is illustrated a compressor bleed air manifold, generally designated 40, which enhances blade control clearance. In FIG. 2, there is illustrated a cylindrical casing about an axis of the compressor including axially opposed casing sections 42 and 44. The manifold includes axially opposed, generally annular shaped, manifold sections 46 and 48 radially outwardly of and integral with the casing sections 42 and 44 respectively. The sections 46 and 48 define a generally annular shaped manifold plenum 50 in communication with the air flowing along the flow path through bleed air slots described below. The casing sections 42 and 44 together with the respective integral manifold sections 46 and 48 may each comprise full circle or annular sections about the flow path. In certain compressors, however, the casing sections and manifold sections comprise semi-annular members secured one to the other along horizontal midline of the compressor on each of the opposite sides of the vertical joint between the casing and manifold sections by joining horizontal midline flanges to one another. For example, the casing section 42 may comprise semi-circular casing members 43 and 45 joined one to the other along horizontal midline flanges 52 by bolts 54. The casing section 44 may similarly comprise semi-circular casing members 47 and 49 joined one to the other along the horizontal midline flanges 51 by bolts 53. The manifold members integral with the casing members are joined one to the other along the horizontal midline joint by joining manifold member flanges to one another by bolts.

Thus, manifold section 46 includes generally semi-cylindrical manifold members 55 and 57 joined one to the other along the horizontal midline manifold flanges 59 and 61, respectively, by bolts 63. Similarly, manifold section 48 includes generally semi-cyclindrical manifold member 65 and 67 joined one to the other along the horizontal midline manifold flanges 69 and 71, respectively, by bolts 73.

As best illustrated in FIG. 2, each manifold section 46, 48 includes outer and inner vertically extending flanges. For example, the manifold section 46 includes an outer flange 70 while manifold section 48 includes an outer flange 72. The outer flanges 70 and 72 are bolted one to the other by bolts 74 and form an outer bolt circle. The manifold section 46 also includes an inner vertical flange 78 and manifold section 48 includes an inner vertical flange 80. Flanges 78 and 80 are joined one to the other by bolts 82 forming an inner bolt circle.

Figure 3:
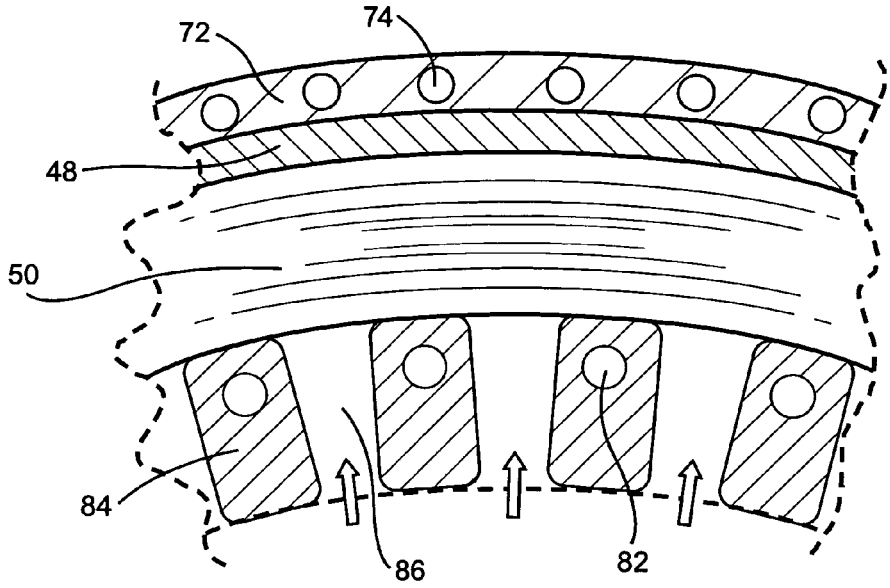
FIG. 3 is a fragmentary cross-sectional view thereof taken generally about on line 3—3 in FIG. 2.

Referring now to FIG. 3, one or both of the flanges 78 and 80 includes a circumferential array of axially projecting circumferentially spaced sectors 84. The sectors 84 on both flanges 78 and 80 abut one another along the vertical joint between manifold sections 46 and 48, and bolts 82 pass through the abutting sectors as well as the flanges 78 and 80 to secure the inner flanges to one another at a location radially adjacent the flow path 16. As illustrated in FIG. 3 the sectors 84 define bleed air slots 86 between circumferentially adjacent sectors for communicating bleed air from the flow path 16 into the plenum 50.

Figure 4:
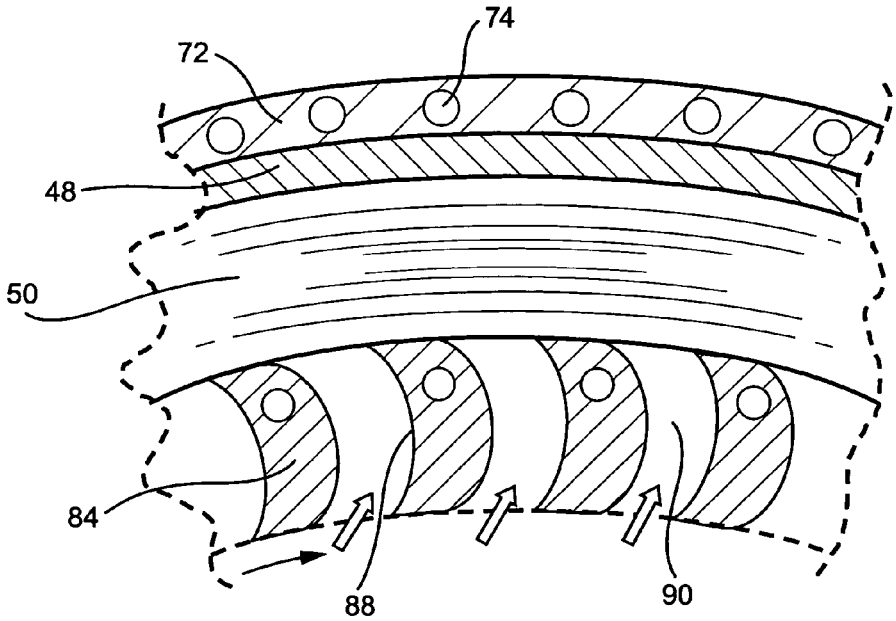
FIG. 4 is a view similar to FIG. 3 illustrating a further embodiment hereof.

As illustrated in FIG. 4, the sectors 84 may define arcuate wall surfaces 88 on opposite sides thereof. The arcuate wall surfaces 88 between adjacent sections 84 define generally radially outwardly arcuately extending slots 90. Preferably the arcuate slots extend from the flow path in a direction generally opposite to the circumferential component of the flow along the flow path to reduce energy losses.

With the foregoing described arrangement of the inner and outer bolt circles, it will be appreciated that the compressor bleed air manifold is mechanically isolated from the engine casing load path. Because the inner bolt circle is radially inwardly of the bleed air manifold and closely adjacent the flow path 16, improved flow path sealing and casing, stiffness and roundness control is achieved. The outer bolt circle maintains the seal about the plenum 50. The arrangement of the inner and outer flanges 78, 80 and 70, 72 respectively, with inner and outer bolt circles also eliminates any wall portions adjacent the bleed air slot which might deflect radially inwardly or outwardly. This provides an enhanced positive clearance control between the rotor blade tips and the wall of the compressor casing at the location of the compressor bleed air manifold. Additionally, mechanical isolation of the manifold from the load carrying compressor casing allows for varying the outer bolt circle radial height and manifold cross section as a function of circumferential position that permits optimal casing stiffness and thermal response for enhanced clearances.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A compressor comprising:

a cylindrical casing about an axis of the compressor including axially opposed casing sections;

a manifold including axially opposed generally annular manifold sections radially outwardly of and integral with the respective casing sections and defining a manifold plenum in communication with a flow path through the compressor casing;

each said manifold section including radially spaced inner and outer flanges on opposite radial sides of said plenum; and bolts through said inner and outer flanges, respectively, forming inner and outer bolt circles securing said axially opposed casing sections to one another and said axially opposed manifold sections to one another.

2. A compressor according to claim 1 including a circumferentially spaced array of axially projecting sectors on one of said manifold sections in engagement with another of said manifold sections axially opposite said one manifold section, said sectors defining circumferentially spaced flow slots therebetween for bleeding compressor air from within said casing into the manifold plenum.

3. A compressor according to claim 2 wherein said sectors have arcuate walls defining slots extending arcuately between the flow path and the plenum.

4. A compressor according to claim 3 wherein said slots extend arcuately in an aerodynamic direction to capture a circumferential flow component through said compressor.

5. A compressor according to claim 2 wherein the bolts of said inner bolt circle pass through said sectors.

6. A compressor according to claim 1 including a circumferentially spaced array of axially projecting sectors on each of said axially opposed manifold sections, said sectors of said manifold sections lying in engagement with one another and defining circumferentially spaced flow slots for bleeding compressor air from within the casing into the manifold plenum, said bolts of said inner bolt circle passing through said sectors.

7. A compressor according to claim 6 wherein each sector of each array of sectors has arcuate walls defining slots extending arcuately from between the flow path and said plenum.

8. A compressor according to claim 7 wherein said slots extend arcuately in an aerodynamic direction to capture a circumferential flow component through said compressor.

9. A compressor according to claim 1 wherein each of said axially opposed casing sections includes a pair of generally semi-cylindrical casing members having circumferentially opposed axially extending flanges secured one to the other along an axially extending midline of the compressor.

10. A compressor according to claim 9 wherein each of said axially opposed manifold sections includes a pair of generally semi-annular manifold members having circumferentially opposed flanges secured to one another along an axially extending midline of the compressor.

11. A compressor comprising:

a cylindrical casing about an axis of the compressor including axially opposed casing sections;

a manifold including axially opposed generally annular manifold sections radially outwardly of and integral with the respective casing sections and defining a manifold plenum in communication with a flow path through the compressor casing;

each said manifold section including radially spaced inner and outer flanges on opposite radial sides of said plenum; and bolts through said inner flanges defining an inner bolt circle for sealing about a compressor flow path through said casing sections and bolts through said outer flanges for sealing about the plenum, said inner and outer bolt circles securing said axially opposed casing sections to one another and said axially opposed manifold sections to one another.

12. A compressor according to claim 11 including a circumferentially spaced array of axially projecting sectors on one of said manifold sections in engagement with another of said manifold sections axially opposite said one manifold section, said sectors defining circumferentially spaced flow slots therebetween for bleeding compressor air from within said casing into the manifold plenum.

13. A compressor according to claim 12 wherein said sectors have arcuate walls defining slots extending arcuately from between the flow path of the casing and said plenum.

14. A compressor according to claim 13 wherein said slots extend arcuately in an aerodynamic direction to capture a circumferential flow component through said compressor.

15. A compressor according to claim 11 including a circumferentially spaced array of axially projecting sectors on each of said axially opposed manifold sections, said sectors of said manifold sections lying in engagement with one another and defining circumferentially spaced flow slots for bleeding compressor air from within the casing into the manifold plenum, said bolts of said inner bolt circle passing through said sectors.

16. A compressor according to claim 15 wherein each sector of each array of sectors has arcuate walls defining slots extending arcuately from between the flow path and said plenum.

17. A compressor according to claim 16 wherein said slots extend arcuately in a direction opposite to a direction of a circumferential flow component through said compressor.

18. A compressor according to claim 11 wherein each of said axially opposed casing sections includes a pair of generally semi-cylindrical casing members having circumferentially opposed axially extending flanges secured one to the other along an axially extending midline of the compressor.

19. A compressor according to claim 18 wherein each of said axially opposed manifold sections includes a pair of generally semi-annular manifold members having circumferentially opposed flanges secured to one another along an axially extending midline of the compressor.

20. A compressor comprising:

a cylindrical casing about an axis of the compressor including axially opposed casing sections, each of said axially opposed casing sections including a pair of generally semi-cylindrical casing members having circumferentially opposed axially extending flanges secured one to the other along an axially extending midline of the compressor;

a manifold including axially opposed generally annular manifold sections radially outwardly of and integral with the respective casing sections and defining a manifold plenum in communication with a flow path through the compressor casing, each of said axially opposed manifold sections including a pair of generally semi-annular manifold members having circumferentially opposed flanges secured to one another along an axially extending midline of the compressor;

each said manifold member including radially spaced, inner and outer vertical flanges on opposite radial sides of said plenum;

bolts through said inner and outer vertical flanges, respectively, forming inner and outer bolt circles about said axis securing said axially opposed casing sections to one another and said axially opposed manifold sections to one another; and circumferentially spaced array of axially projecting sectors on one of said manifold sections in engagement with another of said manifold sections axially opposite said one manifold section and defining circumferentially spaced flow slots therebetween for bleeding compressor air from within said casing into the manifold plenum.

* * * * *